US006257451B1

(12) United States Patent
Siegel et al.

(10) Patent No.: US 6,257,451 B1
(45) Date of Patent: Jul. 10, 2001

(54) ANTI-CLOG PUMP SPRAYER

(75) Inventors: Kenneth D. Siegel, Redondo Beach; Alejandro Espinoza, West Covina, both of CA (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/584,719

(22) Filed: Jun. 1, 2000

(51) Int. Cl.[7] ..... B67D 1/08
(52) U.S. Cl. ..... 222/148; 222/380; 239/106
(58) Field of Search ..... 222/148, 380, 222/182, 321.3, 375; 239/106, 114

(56) References Cited

U.S. PATENT DOCUMENTS 5,105,988 * 4/1992 Knickerbocker ..... 222/148
5,207,785 * 5/1993 Knickerbocker ..... 222/148
5,255,823 * 10/1993 Tichy et al. ..... 222/153
5,785,208 * 6/1998 Dobbs et al. ..... 222/148
6,158,625 * 12/2000 Siegel et al. ..... 222/148

* cited by examiner

*Primary Examiner*—Kevin Shaver
*Assistant Examiner*—Stephanie Willatt
(74) *Attorney, Agent, or Firm*—Dykema Gossett PLLC

(57) ABSTRACT

A manually actuated pump sprayer has a cover on the plunger head which is shifted relative thereto, the cover having an opening for exposing the discharge orifice when relatively shifted. In a non-use condition a portion of the cover side wall fluid tightly seals the orifice closed by engaging a circular seal bead provided on the outer face of the orifice cup concentric with the orifice. The outer face of the orifice cup may be textured to increase the hang time of any residual liquid product at that area which is likewise prevented from drying to avoid clogging by the sealed condition presented between the cover and the circular seal bead in the non-use position.

12 Claims, 2 Drawing Sheets

20
21
22
23
24
25
26
27
28
29
31
32
33
34
35
36
37
38
39
41
42
43
44
46
48
53
54
C

ANTI-CLOG PUMP SPRAYER

BACKGROUND OF THE INVENTION

This invention relates generally to a manually actuated pump sprayer having a means which prevents clogging of the discharge orifice due to product drying at the orifice.

Prior art pumps of the general type as aforedescribed are known as having some type of anti-clog means such as the provision of a small projection extending into the orifice opening from outside the orifice cup. The projection is provided on a cover overlying the plunger head and shiftable relatively thereto for both sealing the orifice closed and for breaking away any accumulated dried product which may have accumulated on the outside surface of the orifice cup. U.S. Pat. Nos. 5,207,785 and 5,105,988 are examples of such prior art.

U.S. Pat. No. 5,785,208 likewise discloses a manual pump sprayer having an overcap on the plunger head shiftable relatively thereto, a projection on the overcap extending into the orifice at the outer surface of the orifice cup, and a suck-back feature being provided for suctioning any product away from the orifice to avoid clogging.

These solutions to prevent orifice clogging are not, however, without their disadvantages. For example, extending a protrusion or the like into the orifice from the outer surface of the orifice cup for anti-clogging purposes, could over time distort the orifice and thereby adversely affect the quality of spray through the orifice. Also the protrusion on the overcap could after repeated use overshoot or undershoot the orifice in the non-use position such that the protrusion is out of axial alignment with the orifice in a non-use position thereby defeating the anti-clog feature.

U.S. Pat. Nos. 3,680,738 and 3,351,247 each disclose sealing of the discharge passage or orifice of a dispenser in a non-use position, the discharge passage reciprocating relative to a stationary wall surrounding the plunger having an opening with which the orifice is axially aligned when plunged. However, each such dispenser has but a single plunger return spring rendering it more difficult to control the alignment between the orifice and the fixed cover opening. Also a seal bead or a ring at the orifice becomes abraded after repeated use as it scrapes along the inner edge of the orifice formed in the fixed wall during each plunger reciprocation. Such abrasion adversely affects the seal function.

SUMMARY OF THE INVENTION

It is therefore an object of the present invention to provide an anti-clog feature for a manually actuated pump dispenser that avoids the aforenoted drawbacks yet is economical to produce and assemble, is highly efficient and is simple to operate. The anti-clog feature according to the invention is in the form of a circular seal bead provided in the outer face of the orifice cup concentric with the orifice, and a cover on the plunger head being relatively reciprocable therewith having an opening axially aligned with the orifice upon depression of the cover prior to plunger depression. At the end of the suction stroke a wall portion of the cover having a smooth inner surface slides over the circular seal bead and seals thereagainst to thereby avoid clogging at the orifice due to the drying of any residual product after spraying.

In accordance with another feature of the invention, the outer face of the orifice cup within the circular seal bead is textured to avoid product run off after spraying.

Other objects, advantages, and novel features of the invention will become more apparent from the following detailed description of the invention when taken in conjunction with the accompanying drawings.

DETAILED DESCRIPTION OF THE INVENTION

Figures 1, 2, 3:
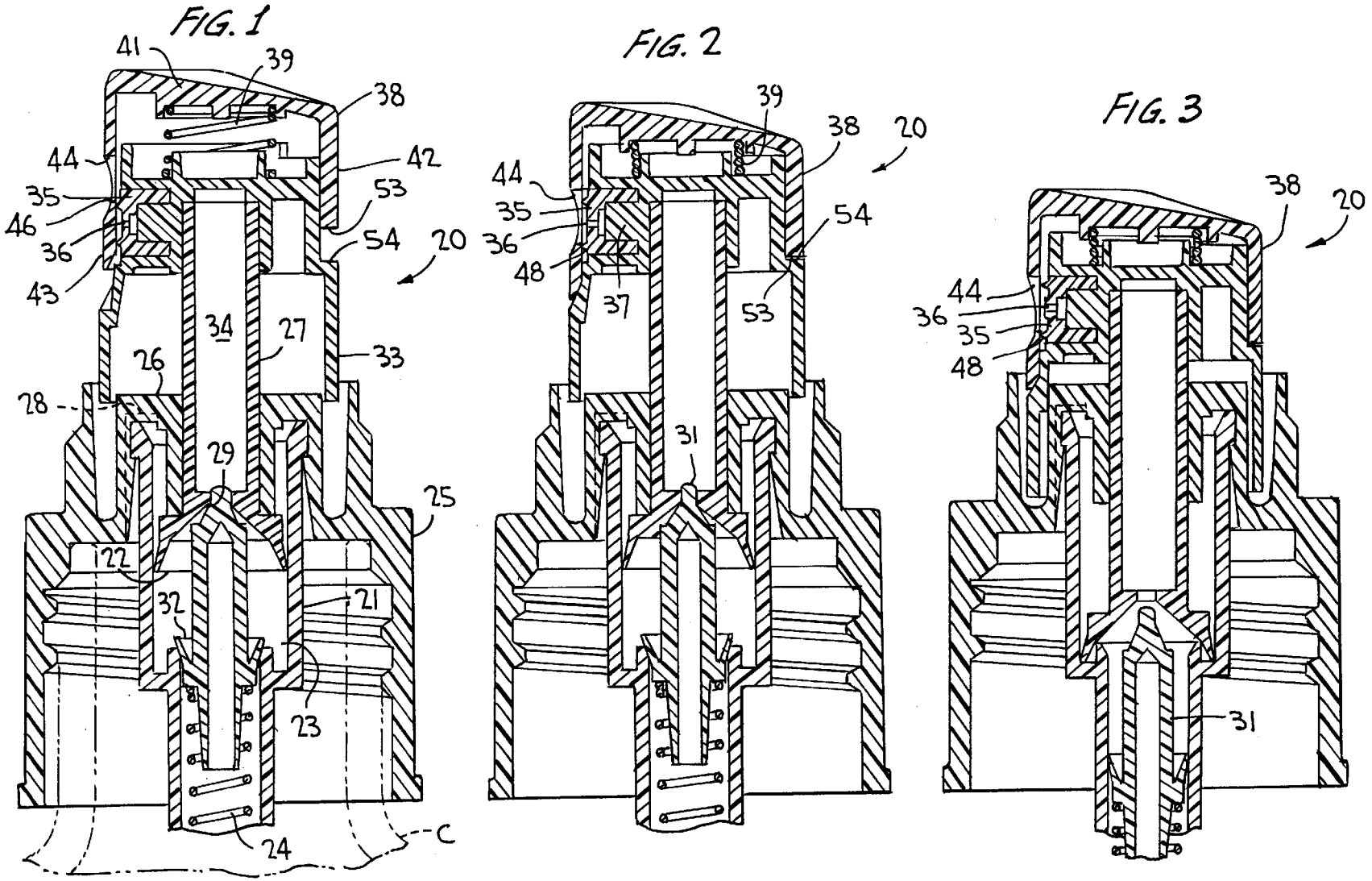
FIG. 1 is a vertical sectional view of a pump sprayer according to the invention, shown in a condition of non-use.
FIG. 2 is a view similar to FIG. 1 showing the cover shifted relative to the plunger head just prior to the plunger pressure stroke.
FIG. 3 is a view similar to FIG. 1 showing the end of the plunger pressure stroke.

Turning now to the drawings wherein like and reference characters refer to like and corresponding parts throughout the several views, a manually actuated pump sprayer of the precompression variety is generally designated 20 in FIGS. 1 to 3 and is structured similar to that of U.S. Pat. No. 5,785,208, commonly owned herewith. Thus the pump has a pump cylinder 21 receiving an axially reciprocable pump piston 22 which together define a variable volume pump chamber 23. The pump cylinder has a reduced diameter portion housing a piston return spring 24 and supporting a dip tube (not shown) which normally extends into container C to which the pump sprayer is mounted.

The upper end of the pump cylinder is snap-fitted or otherwise mounted within a threaded container closure 25 provided for mounting sprayer 20 to the threaded neck of the container. A crown portion 26 has a central opening through which a hollow piston stem 27 of the piston extends. A container vent groove 28 is provided in crown portion 26 for venting the container in the manner similar to that described in U.S. Pat. No. 4,051,983.

The piston stem has a discharge valve seat 29 against which the nose of the discharge poppet valve 31 is seated in the non-use or at rest position of the pump sprayer of FIGS. 1 and 2. The poppet valve is spring biased into its closed position under the force of piston return spring 24 which may be in the form of a coil spring.

The poppet has an inlet valve seal 32 which may be in the form of a resilient, upwardly directed conical valve chevron which disengages from the wall of the upper end of the reduced portion of the pump cylinder for inletting liquid product into the pump chamber during each suction stroke of the piston, and which resiliently deforms as in FIG. 3 closing the inlet passage during pumping.

Mounted on the upper end of the piston stem is a plunger head 33, the hollow piston stem defining a discharge passage 34 opening into the head. Mounted in the plunger head is an orifice cup 35 having an end wall containing a discharge orifice 36, the orifice cup surrounding a probe 37 to therewith define some type of spin mechanics as known in the art for creating a vortex of liquid product feed from the discharge passage such that liquid is discharged through orifice 36 in the form of a fine mist spray during pumping.

A cover 38 overlies the plunger head and is axially shiftable relative thereto against the bias of a spring 39 having a lighter spring force compared to that of piston return spring 24. The cover has a top end wall 41 contoured as in some normal manner to provide a finger rest for the operator. Also the cover has a depending side wall 42 telescoped about the side wall of the plunger head, wall 42 having a portion 43 which overlies the discharge orifice in the relaxed condition of the cover and the plunger as shown in FIG. 1. And, as shown more clearly in FIGS. 4, 5, 8 and 9, side wall 42 of the cover has an opening 44 adjacent portion 43 for uncovering the discharge orifice in a manner as will be made clear hereinafter.

Figure 4:
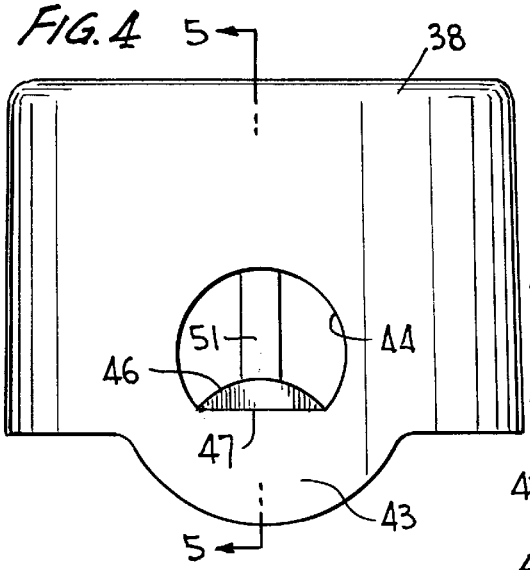
FIG. 4 is a view, at an enlarged scale, of the plunger cover in accordance with the invention in side elevation.
Figure 8:
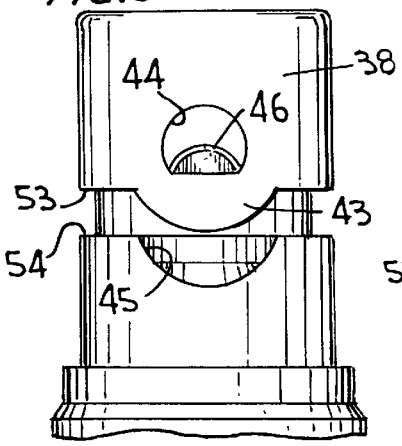
FIG. 8 is a side elevational view at a slightly enlarged scale of the plunger head and cover showing the orifice sealed closed in a non-use position.
Figure 9:
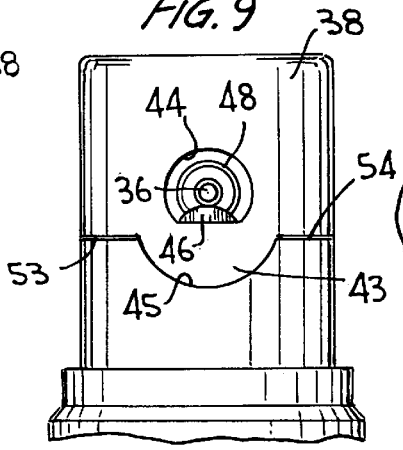
FIG. 9 is a view similar to FIG. 8 showing the cover shifted relative to the plunger head and exposing the orifice.

As seen especially in FIGS. 4, 8 and 9 portion 43 of the side wall of the cover is formed in an arcuate lower extension of the cover side wall which, in the position in which the cover is relatively depressed to that of the plunger head to a position covering the orifice, as shown in FIGS. 3 and 9, portion 43 is mated with a cutout portion 45 formed in the outer surface of the depending skirt of the plunger head.

Figure 5:
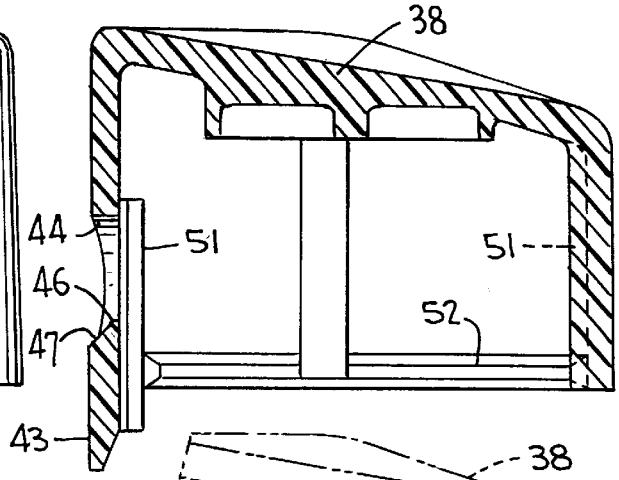
FIG. 5 is a sectional view taken substantially along the line 5—5 of FIG. 4.

Also portion 43 of the cover side wall has a curved section 46 to assure that orifice 36 is covered in the non-use position of FIGS. 1 and 8. That portion 46 may, as shown in FIG. 5, have a sloping outer surface 47.

Provided on the outer face of the orifice cup is an integral circular seal bead 48 concentric with the discharge orifice. The seal bead may be V-shaped in cross-section presenting a circular line against which the smooth inner surface of portion 43 of the cover side wall sealingly engages.

Figure 6:
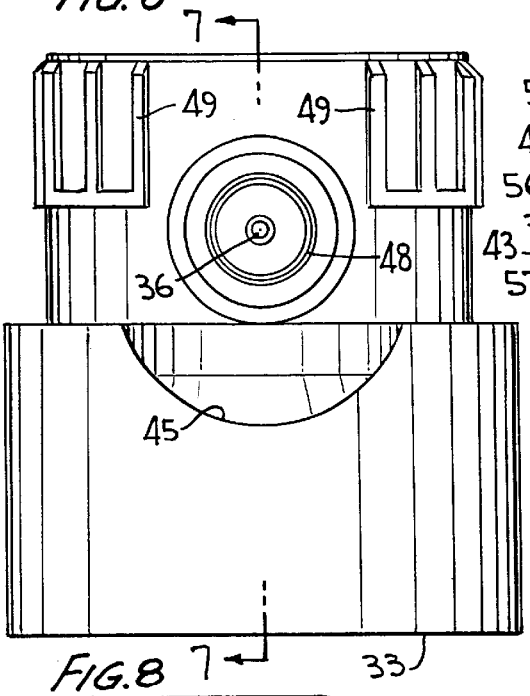
FIG. 6 is a side elevational view of the plunger head of a pump sprayer of FIG. 1.

To maintain opening 44 in alignment with the discharge orifice, the plunger head may be provided with a plurality of longitudinally extending ribs 49 (FIG. 6), and the inner surface of the side wall of the cover may be provided with corresponding longitudinally extending ribs 51 which interengage with ribs 49 to prevent relative shifting between the cover and the plunger head about the central longitudinal axis thereof. And the lower end of the cover skirt may have an internal annular bead 52 in FIG. 5 (which may be continuous or interrupted) in engagement with a lower edge of ribs 49 (FIG. 7) to thereby act as a stop to limit the cover to its position of FIGS. 1 and 7 relative to the plunger head in a non-use condition.

In operation, assuming the pump chamber is primed with liquid to be dispensed, spring 39 maintains the cover resiliently spaced apart in an axial direction relative to the plunger head a maximum extent as permitted by stop bead 52, as shown in FIG. 1. In that position portion 43 of the side wall of the cover overlies discharge orifice 36 and the smooth inner surface of portion 43 sealingly engages seal bead 48 to thereby avoid the drying of liquid product lying in and around the discharge orifice which would otherwise tend to clog the orifice and thereby affect the quality of spray.

In readiness for spraying, the operator simply depresses cover 38 against the force of its spring 39 to its position shown in FIGS. 2 and 9 at which lower edge 53 of the cover side wall abuts against shoulder 54 formed in the side wall of the plunger head to thereby arrest shifting movement of the cover toward the head to its position shown in FIGS. 2 and 9 in which discharge orifice 36 is uncovered. In such position opening 44 is placed in a position in alignment with the discharge orifice, and the free edge of curved position 46 of portion 43 lies below the discharge orifice, as clearly seen in FIGS. 2, 3 and 9.

The further application of a downward force by the operator against the top wall of the cover lowers the cover and the plunger head together during the pressure stroke of the piston, as shown in FIG. 3. As typical for precompression pump sprayers of this type, as the pressure within the pump chamber accumulates and exceeds the opposing force of piston return spring 24, poppet 31 shifts away from its valve seat against the force of spring 24 to thereby open the discharge permitting product under pressure to be discharged out through the orifice. A reduction of pressure in the pump chamber as a result of dispensing, permits the poppet to reclose the discharge by moving under the force of its return spring back to its discharge closed position such that during the ensuing suction stroke the pump chamber is refilled with product suctioned up through the dip tube via an open inlet valve (not shown), as is known for pumps of this type.

At the end of the piston return stroke (FIG. 2) the cover shifts axially away from the plunger head as the operator completely relaxes the downward finger force applied thereto such that the cover returns to its FIG. 1 position in which portion 43 of the cover side wall again overlies the discharge orifice and seals tightly against circular seal bead 48. Thus in the non-use position of the pump sprayer of FIG. 1, the discharge orifice is sealed against outside air and product in and around the orifice is prevented from drying which would otherwise tend to clog the orifice or otherwise cake and buildup on the outer face of the orifice cup when drying.

Figure 10:
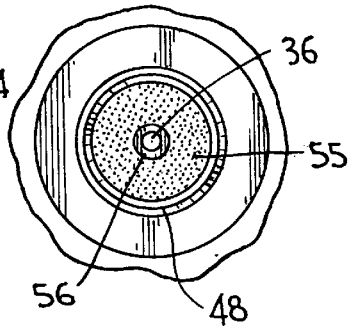
FIG. 10 is an enlarged partial plan view of the orifice cup with the circular seal bead showing the textured area as bounded by the seal bead.

Another feature according to the invention is to provide the outer face of the orifice cup as textured as shown in FIG. 10 as at 55. By "textured" it is meant that the otherwise smooth outer surface portion of the orifice cup within circular seal bead 48 is roughened to a predetermined extent so that any beads of residual liquid product which may tend to collect on the outer surface of the orifice cup after spraying is completed will tend to be confined to an area within that defined by seal bead 48. And as portion 43 tightly seals against the circular seal bead in the FIGS. 1 and 8 positions the drying of liquid product which may collect on the outer surface of the orifice cup within the circular seal bead is avoided as that area is now not exposed to air.

Figure 7:
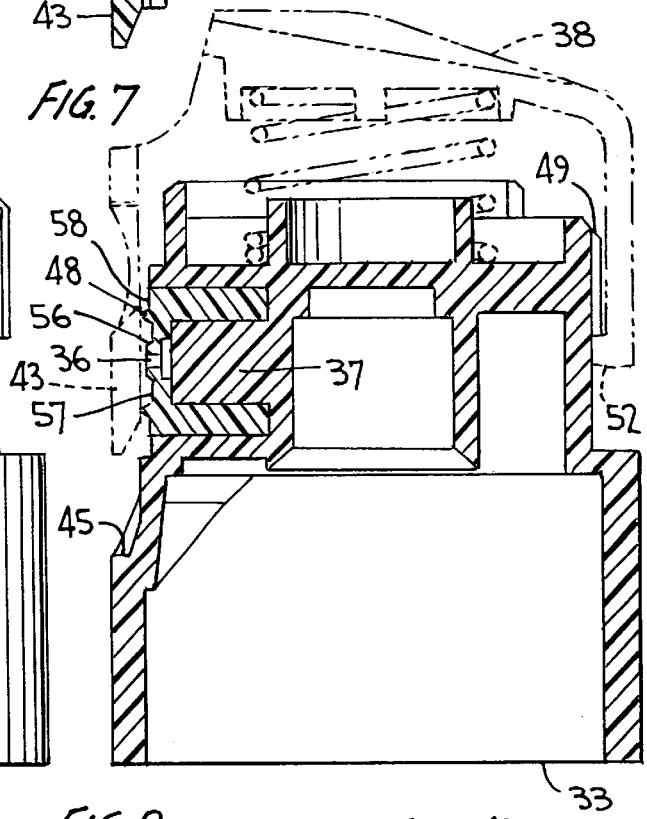
FIG. 7 is a sectional view taken substantially along the line 7—7 of FIG. 6 and showing the relative position of the cover in its non-use condition in phantom outline.

Furthermore as shown in FIG. 7 of the drawings, the orifice cup is immediately surrounded by a puckered, annular bead 56 having a lateral extent which is less than the lateral extent of bead 48 away from outer surface of the orifice cup. Thus in the closed and sealed position of the orifice shown in FIG. 7, annular bead 56 is not contacted by the smooth inner surface of portion 43 but is rather spaced slightly therefrom. And as more clearly shown in FIG. 10 textured surface 55 comprises an annular surface which is confined between annular bead 56 and circular seal bead 48. This annulus between beads 56 and 48 defines a well 57 (FIG. 7) at the outer face of the orifice for entraining any beads of residual liquid product issued from the orifice. The textured surface 55 assists in enhancing the hangtime of any such beads to avoid wetting of plunger head 33 or the operator's hand during a spray operation. Moreover, as best seen in FIG. 7, the outer face of the orifice cup radially outwardly of bead 48 is concave as at 58 for further capturing any residual product as portion 43 of cover 38 wipes against seal bead 48 as described in detail above.

From the foregoing it can be seen that a simple and economical yet highly effective anti-clog device has been devised for a manually actuated pump sprayer in which a portion of the cover fluid tightly seals the orifice closed in a non-use position by the provision of a circular seal bead coaxial with the orifice and located on the outer surface of the orifice cup. Certainly the seal bead cross-section may be other than that specifically described without departing from the invention. And other modifications and variations of the present invention are made possible in the light of the above teachings. It is to be therefore understood that within the scope of the appended claims the invention may be practiced otherwise than as specifically described.

What is claimed is:

1. A manually actuated pump sprayer adapted to be mounted on a container of liquid to be sprayed upon pump actuation, comprising, a plunger head having a side wall containing a discharge orifice, said plunger head being reciprocable against a predetermined biasing force provided by a first spring, a cover surrounding said plunger head and being independently reciprocable against a biasing force of a second spring less than said predetermined force, said cover having a side wall with a portion thereof overlying said discharge orifice in a condition of non-use, said side wall having an opening adjacent said portion in alignment with said discharge orifice only upon relative shifting movement of said cover against the biasing force of said second spring, the improvement wherein an outer face of said plunger head side wall has an integral circular seal bead extending laterally outwardly of said face to a predetermined extent and concentric with said discharge orifice, and said side wall portion of said cover has a smooth inner face bearing against the entirety of said circular seal bead in said condition of non-use to thereby form a fluid tight seal to prevent any clogging of the orifice upon drying of any residual liquid at the orifice.

2. The pump sprayer according to claim 1, wherein said outer surface of said plunger head side wall located solely within said circular seal bead defines a roughened textured surface area for retaining the residual liquid and together with the seal bead confining the residual liquid to an area bounded by the seal bead.

3. The pump sprayer according to claim 2, wherein said outer surface of said plunger head side wall has an annular protrusion immediately adjacent and concentric to the orifice and extending laterally outwardly an extent less than said predetermined extent, the roughened textured area being confined to an annular portion of the outer surface located between the annular protrusion and the circular seal bead.

4. The pump sprayer according to claim 1, wherein said outer face of said plunger head side wall has an annular protrusion immediately adjacent and concentric to the orifice, the circular seal being spaced radially outwardly of said protrusion to therewith define an annular well for entraining any of the residual liquid at the orifice.

5. The pump sprayer according to claim 1, wherein said outer face of said plunger head side wall radially outwardly of said seal bead is concave for capturing any residual product from the orifice.

6. The pump sprayer according to claim 3, wherein said outer face of said plunger head side wall radially outwardly of said seal bead is concave for capturing any residual product from the orifice.

7. The pump sprayer according to claim 4, wherein said outer face of said plunger head side wall radially outwardly of said seal bead is concave for capturing any residual product from the orifice.

8. The pump sprayer according to claim 1, wherein inter-engaging stop means are provided on said plunger head and on said cover for arresting the relative shifting movement of said cover.

9. The pump sprayer according to claim 8, wherein said stop means comprise a bead on said inner face and a rib on said plunger head side wall.

10. A manually actuated pump sprayer comprising, a plunger head mounted for reciprocation against the bias of a piston return spring, cover means independently shiftable relative to said head under the bias of spring means having a predetermined spring force less than the spring force of said return spring, said cover means having a finger engaging end wall overlying an end wall of said head and a skirt of said cover means overlying a side wall of said head which contains a discharge orifice, a portion of aid skirt covering said discharge orifice in an at rests condition of the sprayer, said skirt having an opening adjacent said portion in alignment with said discharge orifice for uncovering said orifice during a shift of said cover means relative to said head, the improvement wherein said side wall includes a circular seal bead of predetermined diameter concentric with said orifice, said seal bead protruding laterally beyond an outer terminal end of said orifice, said skirt portion being sized as to engage the entirety of said seal bead in said at rest condition for providing a fluid tight seal about said orifice to avoid clogging of the orifice due to drying of any residual liquid after spraying.

11. The manually actuated pump sprayer according to claim 10, wherein the outer surface portion of said side wall within said circular seal bead is textured so as to prevent together with the circular seal bead any of the residual liquid from wetting said side wall outside said seal bead.

12. The manually actuated pump sprayer according to claim 11, wherein said side wall has an annular protrusion at said orifice defining together with said seal bead an annular well, said textured surface portion being confined to said annular well.

* * * * *